US010535480B2

(12) United States Patent
Steding

(10) Patent No.: US 10,535,480 B2
(45) Date of Patent: Jan. 14, 2020

(54) GAS-INSULATED CIRCUIT BREAKER AND A METHOD FOR BREAKING AN ELECTRICAL CONNECTION

(71) Applicant: ABB Schweiz AG, Baden (CH)

(72) Inventor: Guenter Steding, Lottstetten (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/948,561

(22) Filed: Apr. 9, 2018

(65) Prior Publication Data

US 2018/0294116 A1 Oct. 11, 2018

(30) Foreign Application Priority Data

Apr. 7, 2017 (LU) ..... LU100163

(51) Int. Cl.

*H01H 3/60* (2006.01)
*H01H 33/56* (2006.01)
*H01H 33/74* (2006.01)

(52) U.S. Cl.

CPC ..... *H01H 33/74* (2013.01); *H01H 3/605* (2013.01); *H01H 33/56* (2013.01); *H01H 2221/024* (2013.01)

(58) Field of Classification Search

CPC ..... H01H 3/605; H01H 33/42; H01H 33/56; H01H 33/74; H01H 33/121; H01H 33/565; H01H 33/78

USPC ..... 218/57, 59, 60, 61, 65, 67, 68, 76, 78, 218/80, 146

See application file for complete search history.

(56) References Cited

U.S. PATENT DOCUMENTS 2,430,008 A 11/1947 Fernier
3,655,935 A 4/1972 Houben
4,430,535 A * 2/1984 Berg ..... H01H 3/605 200/325
4,450,329 A * 5/1984 Arimoto ..... H01H 33/7023 218/57

(Continued)

FOREIGN PATENT DOCUMENTS

DE 838008 7/1949
DE 3104411 A1 8/1982
DE 102014102929 A1 9/2015

OTHER PUBLICATIONS

Translation of DE102014102929 (Original document published Sep. 10, 2015) (Year: 2015).*

(Continued)

*Primary Examiner* — Edwin A. Leon
*Assistant Examiner* — William A Bolton
(74) *Attorney, Agent, or Firm* — Taft Stettinius & Hollister LLP; J. Bruce Schelkopf

(57) ABSTRACT

A gas-insulated circuit breaker is disclosed that includes a housing defining a gas volume for a dielectric gas; a nominal contact system and an interruption contact system with a pin and a tulip that they are electrically connectable to and disconnectable from one another along an axis. The circuit breaker includes a guiding assembly including a guide sleeve and a guiding member that is coupled to the pin; and a gas damping assembly configured to damp a breaking movement of the pin by compressing the dielectric gas in an absorber volume. A movable absorption element and the absorber volume are arranged radially inward of the guide sleeve.

20 Claims, 5 Drawing Sheets

(56) References Cited

U.S. PATENT DOCUMENTS

| | | | | |
|---|---|---|---|---|
| 5,045,651 | A * | 9/1991 | Seki | H01H 33/91 218/57 |
| 6,429,394 | B2 * | 8/2002 | Hunger | H01H 33/904 218/155 |
| 7,919,720 | B2 * | 4/2011 | Shimizu | H01H 33/90 218/55 |
| 9,165,732 | B2 * | 10/2015 | Otani | H01H 33/7046 |
| 2005/0168891 | A1 | 8/2005 | Nilman-Johansson et al. | |
| 2011/0084048 | A1 * | 4/2011 | Manzoni | H01H 33/12 218/146 |
| 2015/0194280 | A1 * | 7/2015 | Uchii | H01H 33/88 218/52 |
| 2015/0279582 | A1 * | 10/2015 | Heiermeier | H01H 3/00 200/337 |

OTHER PUBLICATIONS

Luxembourg Patent Office, Search Report issued in corresponding Application No. LU100163, dated Feb. 20, 2018, 9 pp.

* cited by examiner

GAS-INSULATED CIRCUIT BREAKER AND A METHOD FOR BREAKING AN ELECTRICAL CONNECTION

FIELD

The present application relates to a gas-insulated circuit breaker and a method for breaking an electrical connection, and specifically to a high-voltage gas-insulated circuit breaker and a method for breaking an electrical connection of a high-voltage gas-insulated circuit breaker.

BACKGROUND

Gas-insulated circuit breakers are design to interrupt an current by separating two contacts in an dielectric gas, such as sulfur hexafluoride (SF6), having excellent dielectric and arc-quenching properties. The dielectric gas can be contained in a housing. A nominal contact system and an interruption contact system can be provided in the housing. The nominal contact system can include nominal contacts and can selectively establish a rated current path, i.e. a rated current can be conducted by the nominal contact system. The interruption contact system can include a pin and a tulip can selectively establish a power current path. After separation of the interruption contact system an arc can be formed between the pin and the tulip and current can be carried through the arc.

During the separation the pin can be moved relative to the tulip at a considerably higher speed than the nominal contacts. Gas-insulated circuit breakers are commonly designed such that a damping of the separation movement is can be provided at the end of the separation movement. Typically, a compression volume is available to damp out the movement of the pin relative to the tulip.

There are gas-insulated circuit breakers, in which the damping is achieved by a compression volume provided around the pin. Structural and tightness requirements are guaranteed by a series of guiding and sealing rings. While this system may be effective, the high number of parts and the design is such that a high number of parts with extremely tight tolerances must be put in place. Additionally the usage of the volume around the pin as damping element require a rather lengthy pin implying a lengthy interrupting housing, pole frame and enclosure.

DE 10 2014 102929 A1 describes a circuit breaker having a gas damper for damping a movement of a pin. The gas damper is operatively coupled to the pin. Specifically, the pin or a piston coupled to the pin can be moved into the gas damper for damping the separation movement of the pin relative to the tulip.

SUMMARY

The above-mentioned shortcomings, disadvantages and problems are addressed herein which will be understood by reading and understanding the following specification. Specifically, the present disclosure outlines a cost efficient and reliable contact for a low voltage circuit breaker.

According to an aspect, gas-insulated circuit breaker is provided. The gas-insulated circuit breaker includes a housing defining a gas volume for a dielectric gas. The gas-insulated circuit breaker further includes a nominal contact system with a first nominal contact and a second nominal contact that are electrically connectable and disconnectable relative to one another, and an interruption contact system with a pin and a tulip corresponding to the pin such that they are electrically connectable to and disconnectable from one another. At least the pin is moveable along an axis of the gas-insulated circuit breaker for selectively providing and breaking an electrical connection with the tulip. The gas-insulated circuit breaker further includes a guiding assembly including a guide sleeve and a guiding member for guiding the pin along the axis formed by the switching axis, wherein the guiding member is coupled to the pin and configured to be moved together with the pin while being glidingly guided in the guide sleeve along a guiding length. This is understand as a behavior of the guiding member like a piston or plunger running in a cylinder formed by the guide sleeve. The gas-insulated circuit breaker further includes the gas damping assembly configured to damp a breaking movement of the pin by compressing the dielectric gas in an absorber volume and having at least one moveable absorption element configured to be moved at least partially along the guiding length for compressing the dielectric gas in the absorber volume. The absorber volume and the at least one moveable absorption element are arranged radially inward of the guide sleeve. The term radially inward is understood as being located in the tubular interior space radially delimited by the guide sleeve.

Depending on the embodiment, the absorber volume may axially overlap with the guiding length. The term 'overlap' is understood such that the absorber volume does not exceed a guiding length along which the guiding member can move. Expressed in other words, the absorber volume is arranged within a stroke length of the guiding member with respect to the axis defining the switching axis. Such an arrangement allows for achieving particularly compact gas-insulated circuit breakers.

According to embodiments, the at least one moveable absorption element can be mounted at the end of the pin. Particularly simple designs are achievable if the gas damping assembly is located along the axis. The term 'located along the axis' is understood in this context as being coaxially with respect to the axis A forming the switching axis.

Structurally particular simple solutions are achievable if the gas damping assembly is located along the axis and comprises at least one moveable absorption element that is fastened to the guiding member. The least one fixed absorption element is formed correspondingly to the at least one moveable absorption elements such that the at least one moveable absorption element acts as a cylinder whereas the at least one fixed absorption element acts as a piston running in that cylinder or vice versa. The term 'formed correspondingly' is understood as shaped complementary such that their basic shapes match into one another. The term 'are arranged symmetrically to one another' is understood as being aligned to one another.

According to embodiments, the at least one fixed absorption element is fixed relative to the guide sleeve.

According to embodiments, the absorption gas damping assembly can be located radially offset from the axis. Specifically, the gas damping assembly can include at least two moveable absorption elements and at least two fixed absorption elements that may be formed correspondingly to the at least two moveable absorption element, wherein the at least two moveable absorption elements and the at least two fixed absorption elements can be arranged symmetrically to one another with respect to the axis. Depending on the actual requirements, the moveable absorption elements can be structurally connected to the guiding member or structurally detached and independent of the guiding member.

According to embodiments, the gas-insulated circuit breaker can further include an drive system configured to move the pin and the guiding member in a first direction along the axis in order to break the electrical connection between the pin and the tulip.

According to embodiments, the guide sleeve can be at least partially integrated into the first nominal contact or the second nominal contact.

According to embodiments, no sealing element may be provided in between absorption elements acting as a piston and absorption elements acting as a cylinder for the piston. In other words, the gas damping assembly is ungasketed or seal-less. An advantage of such an embodiment resides in that the degree of free movement of the piston is further increased if the piston is dimensioned relative to the cylinder such that no bodily radial seal element or gasket in between the piston and the interior wall of the cylinder is required. Compared to known pneumatic cylinders whose shell surfaces of the pistons are sealed against the cylinder wall by way of a sealing gasket, a sufficient degree of gas sealing is achievable in the present case of fast accelerated pistons in that just a minimal mechanical play is allowed in between the shell surfaces of the piston and the interior wall of the cylinder. That way no friction caused by a sealing element hampers the movement of the piston in the cylinder in the beginning of movement of the piston in an acceleration stage of the movement.

According to embodiments, the cylinder for the piston can have a conical cross-section having its smallest diameter at an end of the piston stroke.

According to embodiments, the cylinder for the piston can have at least one cut-out for allow an easier escape of the trapped gas before the piston reaches its end position. The term 'easier escape' is understood as causing less pneumatic resistance in a first initial position of opening the circuit breaker compared to a second opening position of the circuit breaker proximate to a fully open state of the interruption contact elements.

Mechanically simple solutions are achievable if at least one fixed absorption element is fixed, meaning fixedly positioned relative to the guide sleeve.

Compared to conventional circuit breakers, the overall compactness in dimension of the circuit breaker promoted herein is further reduced, i.e. minimized in that the gas-insulated circuit breaker further comprises a drive system configured to move the pin and the guiding member along the axis. The drive system is coupled to the guiding member by at least one transmission element that is extending into the interior of the guide sleeve such that the pin is driven by the guiding member. The term 'interior of the guide sleeve' is understood as the hollow space within the guide sleeve that is delimited by the guide sleeve in the radial direction with respect to the axis/switching axis. Depending on the embodiment and the requirements, the damping assembly is arranged at least partially alongside the at least one transmission element with respect to the axis of the gas-insulated circuit breaker. That way, the overall compactness of the gas-insulated circuit breaker can be increased and minimized additionally.

According to embodiments, the gas-insulated circuit breaker can be a high-voltage circuit breaker.

According to embodiments, the gas-insulated circuit breaker can be a generator circuit breaker.

According to embodiments, the gas-insulated circuit breaker can include a network interface for connecting the gas-insulated circuit breaker to a data network. The gas-insulated circuit breaker can be operatively connected to the network interface for carrying out commands received from the data network.

According to an aspect, method for breaking an electrical connection of a gas-insulated circuit breaker is provided. The method includes providing a gas-insulated circuit breaker having a nominal contact system with a first nominal contact and a second nominal contact that are electrically connectable and disconnectable relative to one another, and an interruption contact system with a pin and a tulip corresponding to the pin such that they are electrically connectable to and disconnectable from one another by way of a drive system. A pin is moved in a first direction along an axis of the gas-insulated circuit breaker. The pin is guided by a guiding assembly including a guide sleeve and a guiding member of the gas-insulated circuit breaker, wherein the guiding member is coupled to the pin and configured to be moved together with the pin while being glidingly guided in the guide sleeve along a guiding length. An electrical connection of the gas-insulated circuit breaker is broken. The movement of the pin is damped using absorption a gas damping assembly configured to damp a breaking movement of the pin by compressing an absorber volume and having at least one moveable absorption element configured to be moved at least partially along the guiding length for compressing the absorber volume, wherein the absorber volume and the at least one moveable absorption element is arranged radially inward of the guide sleeve. Depending on the embodiment, the absorber volume may axially overlap with the guiding length.

Embodiments are also directed at apparatuses for carrying out the disclosed methods and include apparatus parts for performing each described method aspect. These method aspects may be performed by way of hardware components, a computer programmed by appropriate software, by any combination of the two or in any other manner. Furthermore, embodiments according to the disclosure are also directed at methods for operating the described apparatus. The methods for operating the described apparatus include method aspects for carrying out functions of the apparatus.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments of the disclosure, one or more examples of which are illustrated in the figures. Within the following description of the drawings, the same reference numbers refer to same components. Typically, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Figure 1:
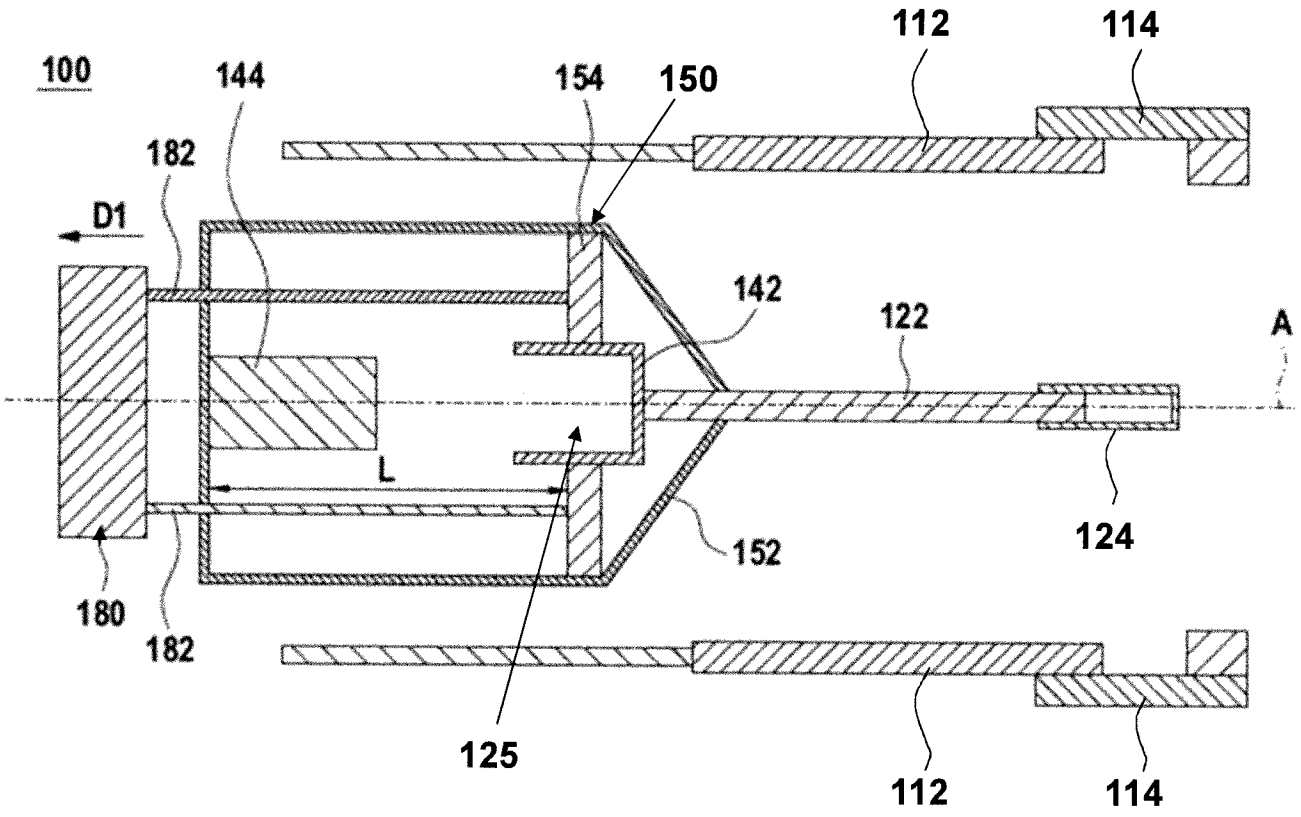
FIG. 1 shows a schematic view of a gas-insulated circuit breaker according to a first embodiment.

FIG. 1 shows a gas-insulated circuit breaker 100. The gas-insulated circuit breaker 100 may include a housing 50 defining a gas volume for a dielectric gas. The gas-insulated circuit breaker 100 can be a high-voltage circuit breaker. In the context of the present disclosure, "high voltage", such in high-voltage circuit breaker, can be understood as a voltage of at least 1 kV, in particular more than 50 kV. Accordingly, a high-voltage circuit breaker can be circuit breaker that is rated for a nominal voltage of at least 1 kV, in particular more than 50 kV.

Further, the gas-insulated circuit breaker 100 can be generator circuit breaker, Generator circuit breakers can be rated for high currents. Specifically, the generator circuit breaker can be rated for a nominal current of at least 7000 A, in particular more than 57000 A.

The gas-insulated circuit breaker 100 can include a nominal contact system and/or an interruption contact system. The nominal contact system can include a first nominal contact 112 and the second nominal contact 114. The first nominal contact 112 and the second nominal contact 114 can be electrically connectable and disconnectable relative to one another. When electrically connected, an ohmic connection between the first nominal contact 112 and the second nominal contact 114 is established, whereas no ohmic connection is between the first nominal contact 112 and the second nominal contact 114 when the disconnected.

The interruption contact with them can include a pin 122 and/or a tulip 124. The tulip 124 may correspond to the pin 122 such that the pin 122 and the tulip 124 are electrically connectable to and disconnectable from one another. In particular, the pin 122 and the tulip 124, which can also be referred to as a first breaker contact and a second breaker contact, can be electrically connected to one another in the closed state of the gas-insulated circuit breaker 100 and/or can be are electrically displaced from one another by an insulation distance and thus electrically disconnected in an open state of the gas-insulated circuit breaker 100.

Further, at least the pin 122 can be moveable along an axis A of the gas-insulated circuit breaker 100 for selectively providing and breaking an electrical connection with the tulip 124. In the context of the present disclosure, "breaking an electrical connection" can be understood as interrupting and current path. Accordingly, at least the pin 122 can be movable along the axis A for selectively moving between the close plate and the open state of the gas-insulated circuit breaker 100. Specifically, the axis A may run through the pin 122.

A guiding assembly 150 can be provided. The guiding assembly 150 can include a guide sleeve 152 and/or a guiding member 154. The guiding member 154 can be coupled to the pin 122 and/or can be configured to be moved together with the pin 122 while being glidingly guided in the guide sleeve 152 along a guiding length L. In this embodiment, the guiding member 154 is permanently and rigidly coupled to the pin 122. The moveable absorption element 142 is structurally connected to the guiding member 154 in a rigid manner.

A gas damping assembly 140 can be provided. The gas damping assembly 140 can be configured to damp a breaking movement of the pin 122. See FIG. 3, for example. Specifically, the gas damping assembly 140 can be configured to damp the breaking movement of the pin 122 by compressing the dielectric gas in an absorber volume 125. The gas damping assembly 140 can include at least one moveable absorption element 142 that can be configured to be moved at least partially along the guiding length L for compressing the dielectric gas in the absorber volume 125. The at least one moveable absorption element 142 and arranged radially inward of the guide sleeve 152. The absorber volume 125 can axially overlap with the guiding length L such as shown in FIG. 1.

In the context of the present disclosure, a gas damping assembly, such as the gas damping assembly 140, can be understood as an assembly configured for damping a movement of mechanical part by compression of a gas. Such gas damping assembly may not to be confused with a mechanical puffer unit used for pressing additional insulation/dielectric gas into the interruption zone for interrupting the electric arc.

The present disclosure provides an optimized kinematic system of a gas-insulated circuit breaker by providing a specific arrangement of the gas damping assembly 140 and the guiding assembly 150. In particular, the gas damping assembly 140 can include parts that are arranged at rear end of the pin 122, such as the moveable absorption element 142, while being radially surrounded by a parts of the guiding assembly 150, such as the guide sleeve 152. In particular, the present may provide a damping of the pin 122 by elements arranged at the rear end of the pin 122.

By the arrangement, a length along which the pin 122 travels during disconnection, i.e. from a connected position to a position in which the movement of the pin 122 is damped out, can be reduced. That is, the piston stroke can be reduced. Further, a diameter of the element acting as a piston can be increased, e.g. as compared to the circuit breaker shown in DE102014102929A1, allowing reaching the same damping effect by a way shorter piston stroke.

According to embodiments described herein, drive system 180 can be provided. The drive system 180 can be configured to move the pin 122 and the guiding member 154 in a first direction D1 along the axis A in order to break the electrical connection between the pin 122 and the tulip 124. The drive system 180 can include, e.g., an actuator for providing a driving force and transition means for transmitting the driving force provided by the actuator to the pin 122. For instance, transmission elements 182 can be provided that can be coupled to the guiding member 154 and/or to transmit the driving force to the guiding member 154. The drive system 180 is indicated in FIG. 1 but not shown in any of FIGS. 2 and 3.

According to embodiments described herein, a front guiding element 156 can be provided at a front end of the guide sleeve 152. In the context of the present disclosure, the front end of the guide sleeve 152 may be understood as the end of the guide sleeve 152 that is arranged along the axis A towards the tulip 124. The front end of the guide sleeve 152 may also be understood as the end of the guide sleeve 152 arranged opposite to the first direction D1. For instance, the front guiding element 156 can be a guide ring. When practicing embodiments, a more reliable guidance of the pin 122 can be provided.

According to embodiments described herein, the guide sleeve 152 can be at least partially integrated into the first nominal contact 112 or the second nominal contact 124. In practice, a more compact and reliable gas-insulated circuit breaker can be provided.

Figure 2:
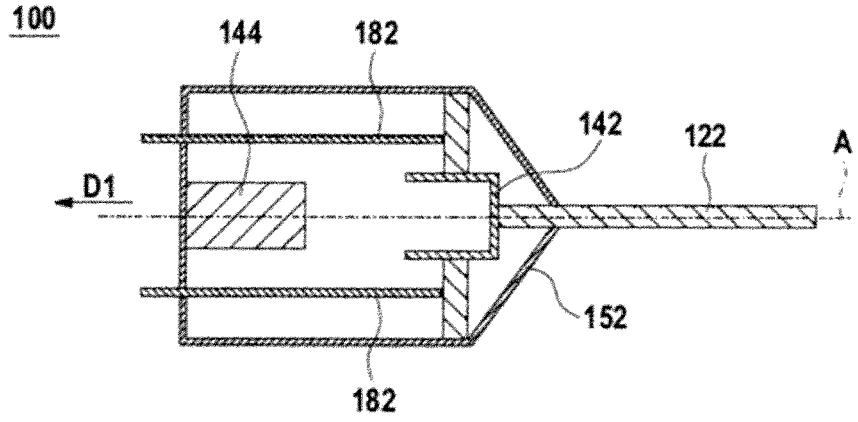
FIGS. 2 and 3 show a schematic views of a gas-insulated circuit breaker according to a second embodiment.
Figure 3:
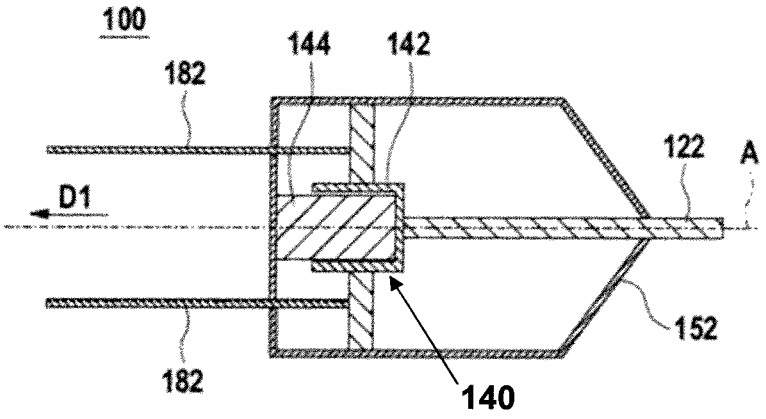

FIG. 2 shows the gas-insulated circuit breaker 100 in a closed state. In the closed state nominal contact 112 and the second nominal contact 114 can be electrically connected. Further, the pin 122 and the tulip 124 can be electrically connected in the closed state. FIG. 3 shows the gas-insulated circuit breaker 100 in an open state. In the open state nominal contact 112 and the second nominal contact 114 can be electrically disconnected. Further, the pin 122 and the tulip 124 can be electrically disconnected in the open state.

As shown in FIGS. 2 and 3, the at least one moveable absorption element 142 can be mounted at the end of the pin 122. Further, the gas damping assembly 140 can be located along the axis A. Specifically, in the embodiment shown in FIGS. 2 and 3, one movable absorption element 142 can be mounted at the end of the pin 122. A fixed absorption element 144 can be provided. The fixed absorption element 144 can be correspondingly formed to the movable absorption element 142.

In particular one of the movable absorption element 142 and the fixed absorption element 144 can act as a piston. The other one of the movable absorption element 142 and the fixed absorption element 144 can act as a cylinder. In particular, the other one of the movable absorption element 142 and the fixed absorption element 144 can act as a cylinder for the piston, specifically the element acting as a piston. In the embodiments shown in FIGS. 2 and 3, the movable absorption element 142 can act as a cylinder, whereas the fixed absorption element 144 can act as a piston. However, although not shown, the movable absorption element 142 may act as a piston, whereas the fixed absorption element 144 may act as a cylinder. Generally, the gas-insulated circuit breaker 100 can include the same amount of movable absorption elements 142 as an amount of fixed absorption elements 144. That is, for each movable absorption element 142 there can be one corresponding fixed absorption element 144. Further, in correspond ones of the movable absorption element 142 and fixed absorption element 144, one element can act a as cylinder whereas the other element can act a as piston.

In the embodiments shown in FIGS. 2 and 3, the guiding member 154 may be coupled to the pin 122 via the movable absorption element 142. Accordingly, the pin 122 can be connected to the movable absorption element 142, which in turn can be connected to the guiding member 154. When practicing embodiments, a stable and reliable connection for guiding the pin 122 can be provided.

When the pin 122 is removed from the closed state depicted in FIG. 2 to the open state depicted in FIG. 3, the movable absorption element 142 is moved towards the fixed absorption element 144. When the movable absorption element 142 approaches the fixed absorption element 144 the dielectric gas can be compressed in the absorber volume 125. In particular, the absorber volume 125 can be provided by the one of the movable absorption element 142 and the fixed absorption element 144 that acts as a piston. In the embodiments shown in FIGS. 2 and 3, the absorber volume 125 would accordingly be provided within the movable absorption element 142. When an embodiment, damping effect can be achieved by compressing be the dielectric gas in the absorber volume 125.

Figure 4:
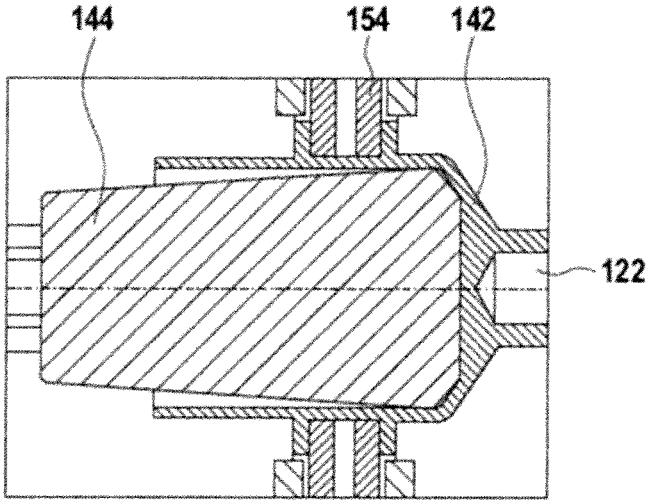
FIG. 4 shows a schematic view of a gas-insulated circuit breaker according to a third embodiment.

FIG. 4 shows an enlarged cross-sectional view of the movable absorption element 142 and the fixed absorption element 144 in the closed state. As shown in FIG. 4, the movable absorption element 142 can abut the fixed absorption element 144 in the closed state. In particular, an end side of the movable absorption element 142 can abut against an end side of the fixed absorption element 144 in the closed state. The end side of the movable absorption element 142 and/or the fixed absorption element 144 can be understood as the end of the piston stroke. Generally, the end of the piston stroke can be understood as referring to the end of the separation movement and may correspond to the open state.

According to embodiments described herein, the element acting as a cylinder 144, 142 for the element acting as a piston 142, 144 can have a conical cross-section having its smallest diameter at an end of the piston stroke. Specifically, the one of the movable absorption element 142 and fixed absorption element 144 acting as a cylinder for the other one of the movable absorption element 142 and fixed absorption element 144 acting as a piston can have a conical cross-section having its smallest diameter at an end of the piston stroke. Accordingly, when the movable absorption element 142 acts as a cylinder for the fixed absorption element 144 acting as a piston, as it is shown in FIGS. 2 and 3, the movable absorption element 142 can have a conical cross-section having its smallest diameter at an end of the piston stroke. That is, the movable absorption element 142 can have its smallest diameter at its end side. Alternatively, when the fixed absorption element 144 acts as a cylinder for the moveable absorption element 142 acting as a piston, the fixed absorption element 144 can have a conical cross-section having its smallest diameter at an end of the piston stroke. That is, the fixed absorption element 144 can have its smallest diameter at its end side.

Alternatively or additionally, the element acting as a piston 142, 144 can have a conical cross-section having its smallest diameter at an end of the piston stroke. Specifically, the one of the movable absorption element 142 and fixed absorption element 144 acting as a piston can have a conical cross-section having its smallest diameter at an end of the piston stroke. Accordingly, when the movable absorption element 142 acts as a cylinder for the fixed absorption element 144 acting as a piston, as it is shown in FIGS. 2 and 3, the fixed absorption element 144 can have a conical cross-section having its smallest diameter at an end of the piston stroke. That is, the fixed absorption element 144 can have its smallest diameter at its end side. Alternatively, when the fixed absorption element 144 acts as a cylinder for the moveable absorption element 142 acting as a piston, the moveable absorption element 142 can have a conical cross-section having its smallest diameter at an end of the piston stroke. That is, the moveable absorption element 142 can have its smallest diameter at its end side.

Figure 5:
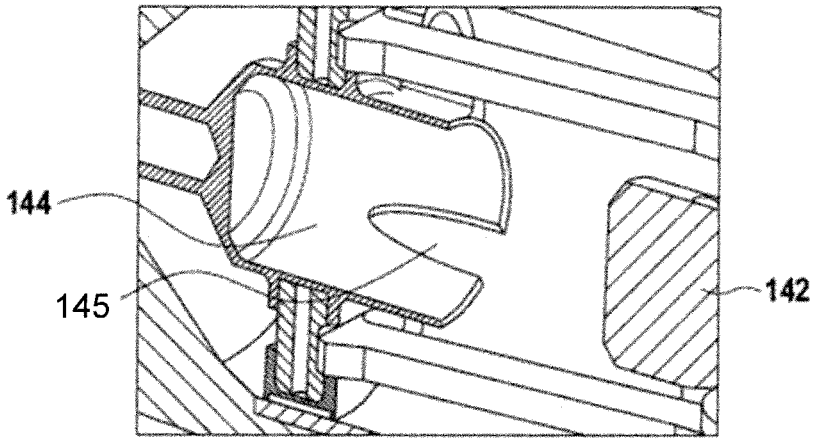
FIG. 5 shows a schematic view of a gas-insulated circuit breaker according to a fourth embodiment.

FIG. 5 shows an enlarged cross-sectional view of the movable absorption element 142 and the fixed absorption element 144 in state having a distance between the movable absorption element 142 and the fixed absorption element 144. According to embodiments described herein, the element acting as a cylinder 144, 142 for the element acting as a piston 142, 144 can have at least one cut-out 145 for allowing an easier escape of the trapped gas before the element acting as a piston 142, 144 reaches its end position. Specifically, the one of the movable absorption element 142 and fixed absorption element 144 acting as a cylinder for the other one of the movable absorption element 142 and fixed absorption element 144 acting as a piston can have at least one cut-out 145 for allowing an easier escape of the trapped gas before the element acting as a piston 142, 144 reaches its end position.

Accordingly, when the movable absorption element 142 acts as a cylinder for the fixed absorption element 144 acting as a piston, as it is shown in FIGS. 2 and 3, the movable absorption element 142 can have at least one cut-out 145 for allowing an easier escape of the trapped gas before the movable absorption element 142 reaches its end position. Alternatively, when the fixed absorption element 144 acts as a cylinder for the moveable absorption element 142 acting as a piston, the fixed absorption element 144 can have at least one cut-out 145 for allowing an easier escape of the trapped gas before the movable absorption element 142 reaches its end position. Further, the end position can be considered as the position shown in FIG. 4. When practicing embodiments, a further design freedom can be obtained in adjusting a damping performance.

According to embodiments described herein, no sealing element can be provided in between elements acting as a piston 144, 142 and elements acting as a cylinder 142, 144 for the piston 144, 142. Specifically, as there is no sealing element provided, no friction end hence no wear occurs between the elements acting as a piston 144, 142 and the elements acting as a cylinder 142, 144 for the piston 144, 142. According to embodiments, the elements acting as a piston 144, 142 and the elements acting as a cylinder 142, 144 for the piston 144, 142 can be guided in such a manner that no contact between the elements acting as a piston 144, 142 and the elements acting as a cylinder 142, 144 for the piston 144, 142 is generated. When practicing embodiments, pollution of the gas-insulated circuit breaker can be reduced and its lifetime can be enhanced.

According to embodiments described herein, the elements acting as a piston 144, 142 and/or the elements acting as a cylinder 142, 144 for the piston 144, 142 can have a larger diameter as the pin 122. Specifically, the at least one movable absorption element 142 and/or the at least one fixed absorption element 144 can have a larger diameter as the pin 122. When practicing embodiments, the piston stroke can be reduced while obtaining a high damping effect. Further, at least one of the at least one movable absorption element 142 and/or at least one of the at least one fixed absorption element 144 can have a larger diameter as the pin 122, whereas other of the at least one movable absorption element 142 and/or other of the at least one fixed absorption element 144 can have an equal or smaller diameter as the pin 122.

Figure 6:
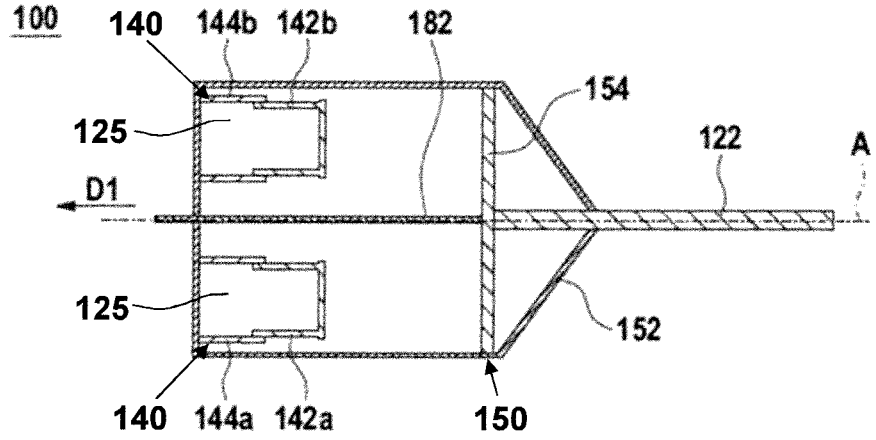
FIGS. 6 to 8 show a schematic views of a gas-insulated circuit breaker according to a second embodiment.
Figure 7:
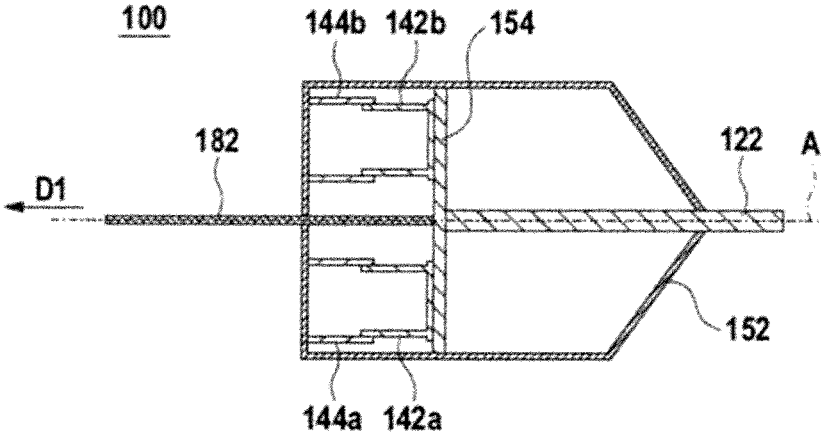
Figure 8:
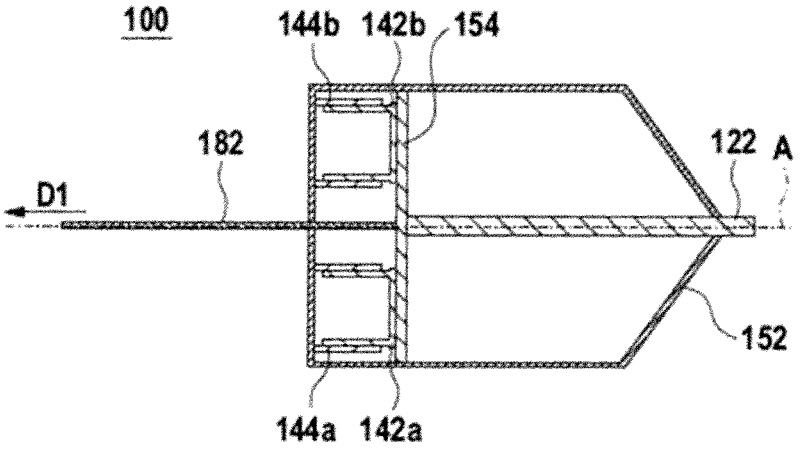

FIGS. 6 to 8 show a gas-insulated circuit breaker 100 according to further embodiments. While features described with respect to the foregoing embodiments can be applied to the embodiments shown in FIGS. 6 to 8, the gas damping assembly 140 can be located radially offset from the axis A in the embodiments shown in FIGS. 6 to 8. In particular, features that are described with respect to one moveable absorption element 142 or one fixed absorption element 144 can apply for more than one or all moveable absorption elements 142 and fixed absorption elements 144, respectively, in the gas-insulated circuit breaker 100. In the same manner, because the public works with respect to more than one moveable absorption element 142 or more than one fixed absorption element 144 can apply for one or all moveable absorption elements 142 and fixed absorption elements 144, respectively, in the gas-insulated circuit breaker 100.

FIG. 6 shows the gas-insulated circuit breaker 100 in the closed state. FIG. 7 shows the gas-insulated circuit breaker 100 a state when the damping is initiated. FIG. 7 shows the gas-insulated circuit breaker 100 in the open state, specifically when damping has occurred.

According to embodiments, the gas damping assembly 140 can include at least two moveable absorption elements 142*a*, 142*b* and at least two fixed absorption elements 144*a*, 144*b* formed correspondingly to the at least two moveable absorption elements 142*a*, 142*b*. The at least two moveable absorption elements 142*a*, 142*b* and the at least two fixed absorption elements 144*a*, 144*b* can be arranged symmetrically with respect to the axis A. When practicing embodiments, a further degree of freedom can be obtained in adjusting a damping performance. In this embodiment, the moveable absorption elements 142*a*, 142*b* are structurally detached and independent of the guiding member 154. In particular, a higher damping effect can be obtained by providing more moveable absorption elements and fixed absorption elements. In practice, the piston stroke can be reduced by providing a greater amount of moveable absorption elements and fixed absorption elements. When practicing embodiments, a compact gas-insulated circuit breaker can be provided.

The damping effect may be further tuned or adjusted in that the element acting as a cylinder 144*a*, 144*b* for the element acting as a piston 142*a*, 142*b* can have at least one cut-out similar to the cut-out 145 explained in the context of FIG. 5 for allowing an easier escape of the trapped gas before the element acting as a piston 142*a*, 142*b* reaches its end position Further, a transmission element 182 driven by the drive system (180) not shown in any of FIGS. 7 and 8 can be provided that can be coupled to the guiding member 154 and/or to transmit the driving force to the guiding member 154. Specifically, the transmission element 182 can be arranged at the axis A behind the pin 122.

Furthermore, as shown in FIGS. 6 to 8, the elements acting as a piston 142*a*, 142*b*, 144*a*, 144*b* can have an open side facing the elements acting as a cylinder 144*a*, 144*b*, 142*a*, 142*b*. Accordingly, when the at least two moveable absorption elements 142*a*, 142*b* act as a piston, as it is shown in FIGS. 6 to 8, the at least two moveable absorption elements 142*a*, 142*b* can have an open side facing the respective one of the at least two fixed absorption elements 144*a*, 144*b*. Alternatively, when the at least two fixed absorption elements 144*a*, 144*b* act as a piston, the at least two fixed absorption elements 144*a*, 144*b* can have an open side facing the respective one of the at least two moveable absorption elements 142*a*, 142*b*. By providing the elements acting as a piston 142*a*, 142*b*, 144*a*, 144*b* with an open side facing the elements acting as a cylinder 144*a*, 144*b*, 142*a*, 142*b*, the absorber volume 125 in which the dielectric gas is compressed can be increased.

Alternatively, as shown in FIGS. 2 and 3, the elements acting as a piston can have a closed side facing the elements acting as a cylinder. Accordingly, when the at least two moveable absorption elements 142*a*, 142*b* act as a piston, the at least two moveable absorption elements 142*a*, 142*b* can have a closed side facing the respective one of the at least two fixed absorption elements 144*a*, 144*b*. Alternatively, when the at least two fixed absorption elements 144*a*, 144*b* act as a piston, the at least two fixed absorption elements 144*a*, 144*b* can have a closed side facing the respective one of the at least two moveable absorption elements 142*a*, 142*b*. By providing the elements acting as a piston 142*a*, 142*b*, 144*a*, 144*b* with a closed side facing the elements acting as a cylinder 144*a*, 144*b*, 142*a*, 142*b*, the absorber volume 125 in which the dielectric gas is compressed can be reduced. In practice, a further degree of freedom can be provided.

According to embodiments described herein, the gas-insulated circuit breaker 100 can further include a network interface for connecting the gas-insulated circuit breaker 100 to a data network, in particular a global data network. The data network can be a TCP/IP network such as Internet. The gas-insulated circuit breaker 100 can be operatively connected to the network interface for carrying out commands received from the data network. The commands can include a control command for controlling the device to carry out a task such as disconnecting or connecting the gas-insulated circuit breaker 100. In particular, the commands can include control command for controlling the movement of the pin 122. In this case, the gas-insulated circuit breaker 100 can be configured for carrying out the task in response to the control command. Further, the commands can include a status request. In this case, the gas-insulated circuit breaker 100 can be configured for sending a status information to the network interface, and the network interface can be adapted for sending the status information over the network in response to the status request. The commands can include an update command including update data. In this case, the gas-insulated circuit breaker 100 can be adapted for initiating an update in response to the update command and using the update data.

Figure 9:
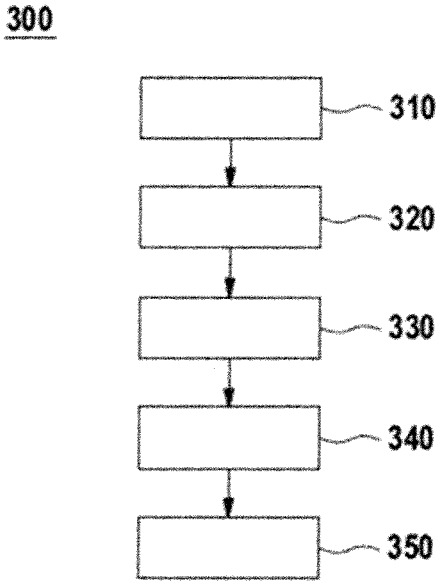
FIG. 9 shows a flow diagram illustrating a method for breaking an electrical connection of a gas-insulated circuit breaker according to an embodiment.

FIG. 9 shows a flowchart of a method 300 for breaking an electrical connection of a gas-insulated circuit breaker 100. In block 310, a gas-insulated circuit breaker 100 can be provided. The gas-insulated circuit breaker 100 can have a nominal contact system with a first nominal contact 112 and a second nominal contact 114 that are electrically connectable and disconnectable relative to one another, and an interruption contact system with a pin 122 and a tulip 124 corresponding to the pin 122 such that they are electrically connectable to and disconnectable from one another. In particular, the gas-insulated circuit breaker 100 can correspond to embodiments described herein.

In block 320, the pin 122 can be moved in a first direction D1 along an axis A of the gas-insulated circuit breaker 100

In block 330, the pin 122 can be guided by a guiding assembly 150. The guiding assembly can include a guide sleeve 152 and a guiding member 154 of the gas-insulated circuit breaker 100. The guiding member 154 can be coupled to the pin 122 and configured to be moved together with the pin 122 while being glidingly guided in the guide sleeve 152 along a guiding length L.

In block 340, an electrical connection of the gas-insulated circuit breaker 100 can be broken.

In block 350, the movement of the pin 122 can be damped using a gas damping assembly 140. The gas damping assembly 140 can be configured to damp a breaking movement of the pin 122 by compressing an absorber volume 125 and having at least one moveable absorption element 142 configured to be moved at least partially along the guiding length L for compressing the absorber volume 125. The at least one moveable absorption element 142 can be arranged radially inward of the guide sleeve 152. The absorber volume 125 can axially overlap with the guiding length L.

While the foregoing is directed to embodiments of the disclosure, other and further embodiments of the disclosure may be devised without departing from the basic scope thereof, and the scope thereof is determined by the claims that follow.

The invention claimed is:

1. A gas-insulated circuit breaker comprising:

a housing defining a gas volume for a dielectric gas;

a nominal contact system with a first nominal contact and a second nominal contact that are electrically connectable and disconnectable relative to one another, and an interruption contact system with a pin and a tulip corresponding to the pin such that they are electrically connectable to and disconnectable from one another, wherein at least the pin is moveable along an axis (A) of the gas-insulated circuit breaker for selectively providing and breaking an electrical connection with the tulip;

a guiding assembly including a guide sleeve and a guiding member, wherein the guiding member is coupled to the pin and configured to be moved together with the pin while being glidingly guided in the guide sleeve along a guiding length (L); and a gas damping assembly configured to damp a breaking movement of the pin by compressing the dielectric gas in an absorber volume and having at least one moveable absorption element configured to be moved at least partially along the guiding length (L) for compressing the dielectric gas in the absorber volume, wherein the absorber volume and the at least one moveable absorption element are arranged radially inward of the guide sleeve.

2. The gas-insulated circuit breaker according to claim 1, wherein the at least one moveable absorption element is mounted at the end of the pin such that the gas damping assembly is located along the axis (A).

3. The gas-insulated circuit breaker according to claim 2, further comprising at least one moveable absorption element that is fastened to the guiding member, and at least one fixed absorption element formed correspondingly to the at least one moveable absorption element such that the at least one moveable absorption element acts as a cylinder whereas the at least one fixed absorption element acts as a piston running in that cylinder or vice versa.

4. The gas-insulated circuit breaker according to claim 3, wherein no sealing element is provided in between absorption elements acting as pistons and absorption elements acting as cylinders.

5. The gas-insulated circuit breaker according to claim 3, wherein the absorption element acting as the cylinder for the absorption element acting as the piston has a conical cross-section having a smallest diameter at an end of a stroke of the piston.

6. The gas-insulated circuit breaker according to claim 1, further comprising at least one moveable absorption element that is fastened to the guiding member, and at least one fixed absorption element formed correspondingly to the at least one moveable absorption elements such that the at least one moveable absorption element acts as a cylinder whereas the at least one fixed absorption element acts as a piston running in that cylinder or vice versa.

7. The gas-insulated circuit breaker according to claim 6, wherein no sealing element is provided in between absorption elements acting as pistons and absorption elements acting as cylinders.

8. The gas-insulated circuit breaker according to claim 6, wherein the absorption element acting as the cylinder for the absorption element acting as the piston has a conical cross-section having a smallest diameter at an end of a stroke of the piston.

9. The gas-insulated circuit breaker according to claim 6, wherein the absorption element acting as the cylinder for the absorption element acting as the piston has at least one cut-out for allowing an easier escape of trapped gas before the piston reaches an end position.

10. The gas-insulated circuit breaker according to claim 6, wherein at least one fixed absorption element is fixed relative to the guide sleeve.

11. The gas-insulated circuit breaker according to claim 1, wherein the gas damping assembly is located radially offset from the axis.

12. The gas-insulated circuit breaker according to claim 11, wherein the gas damping assembly includes at least two moveable absorption elements and at least two fixed absorption elements formed correspondingly to the at least two moveable absorption elements, wherein the at least two moveable absorption elements and the at least two fixed absorption elements are arranged symmetrically to one another with respect to the axis (A) such that the at least two fixed absorption elements act as cylinders whereas the at least two moveable absorption elements act as pistons each running in the cylinders or vice versa.

13. The gas-insulated circuit breaker according to claim 12, wherein no sealing element is provided in between absorption elements acting as pistons and absorption elements acting as cylinders.

14. The gas-insulated circuit breaker according to claim 12, wherein the absorption element acting as the cylinder for the absorption element acting as the piston has a conical cross-section having a smallest diameter at an end of a stroke of the piston.

15. The gas-insulated circuit breaker according to claim 1, wherein the guide sleeve is at least partially integrated into the first nominal contact or the second nominal contact.

16. The gas-insulated circuit breaker according to claim 1, further comprising a drive system configured to move the pin and the guiding member along the axis (A), and wherein the drive system is coupled to the guiding member by at least one transmission element that is extending into an interior of the guide sleeve such that the pin is driven by the guiding member.

17. The gas-insulated circuit breaker according to claim 16, wherein the damping assembly is arranged at least partially alongside the at least one transmission element with respect to the axis of the gas-insulated circuit breaker.

18. The gas-insulated circuit breaker according to claim 1, wherein the gas-insulated circuit breaker is a high-voltage circuit breaker.

19. The gas-insulated circuit breaker according to claim 1, wherein the gas-insulated circuit breaker is a generator circuit breaker.

20. A method for breaking an electrical connection of a gas-insulated circuit breaker, comprising:

providing a gas-insulated circuit breaker having a nominal contact system with a first nominal contact and a second nominal contact that are electrically connectable and disconnectable relative to one another, and an interruption contact system with a pin and a tulip corresponding to the pin such that they are electrically connectable to and disconnectable from one another;

moving the pin in a first direction (D1) along an axis (A) of the gas-insulated circuit breaker;

guiding the pin by a guiding assembly including a guide sleeve and a guiding member of the gas-insulated circuit breaker, wherein the guiding member is coupled to the pin and configured to be moved together with the pin while being glidingly guided in the guide sleeve along a guiding length;

breaking the electrical connection of the gas-insulated circuit breaker; and damping a movement of the pin using a gas damping assembly configured to damp a breaking movement of the pin by compressing an absorber volume and having at least one moveable absorption element configured to be moved at least partially along the guiding length for compressing the absorber volume, wherein the absorber volume and the at least one moveable absorption element is arranged radially inward of the guide sleeve.

* * * * *